United States Patent [19]

Howell

[11] Patent Number: 4,860,718

[45] Date of Patent: Aug. 29, 1989

[54] PROJECTILE TOY

[76] Inventor: Keith C. Howell, 14800 132nd Ave. NE., Kirkland, Wash. 98034

[21] Appl. No.: 278,128

[22] Filed: Nov. 30, 1988

[51] Int. Cl.[4] ..... F41B 7/02

[52] U.S. Cl. ..... 124/18; 124/35 R

[58] Field of Search ..... 124/17, 18, 19, 35 R; 43/135

[56] References Cited

U.S. PATENT DOCUMENTS

| | | | |
|---|---|---|---|
| 1,059,736 | 4/1913 | Kilduff | 43/135 |
| 1,572,350 | 2/1926 | Ecker | 124/19 |
| 1,626,892 | 5/1927 | Tidwell | 124/18 |
| 1,726,829 | 9/1929 | Heinen et al. | 124/18 |
| 1,739,329 | 12/1929 | Sahara | 124/18 |
| 2,535,891 | 12/1950 | Bozarth | 124/18 |
| 2,642,057 | 6/1953 | Watkins | 124/17 |
| 2,708,429 | 5/1955 | Tufts | 124/18 X |
| 3,704,981 | 12/1972 | Pohr | 43/135 |

FOREIGN PATENT DOCUMENTS

| | | | |
|---|---|---|---|
| 648272 | 9/1964 | Belgium | 43/135 |
| 533789 | 12/1921 | France . | |
| 131129 | 5/1929 | Switzerland | 124/35 R |
| 263685 | 12/1949 | Switzerland | 124/18 |

*Primary Examiner*—Randolph A. Reese
*Assistant Examiner*—John Ricci
*Attorney, Agent, or Firm*—Ward Brown; Robert W. Beach

[57] ABSTRACT

A wooden stock has opposite elongated barrel and butt portions and an inclined central or joining section to resemble a standard carbine. The tip of the barrel end of the stock has a rearward-extending blind bore into which an end portion of a tubular elastic projectile is fitted. The projectile is bent abruptly upward and rearward along the top of the barrel to an upright trigger pin over which the rear end of the projectile is fitted. Trigger mechanism is effective to retract the pin so as to release the rear end of the projectile, thereby causing it to fly forward and separate from the tip of the barrel.

4 Claims, 1 Drawing Sheet

PROJECTILE TOY

BACKGROUND OF THE INVENTION

1. Field of the Invention

The present invention relates to a projectile toy in the form of a mechanical gun for shooting an elastic member.

2. Prior Art

Sahara U.S. Pat. No. 1,739,329, issued Dec. 10, 1929, and Bozarth U.S. Pat. No. 2,535,891, issued Dec. 26, 1950, disclose toy guns in which the projectile is an elastic band loop. Tidwell U.S. Pat. No. 1,626,892, issued May 3, 1927, discloses a toy gun in which the projectile includes an elongated elastic member having a large ball connected at one end.

Watkins U.S. Pat. No. 2,642,057, issued June 16, 1953, discloses a toy gun utilizing an elastic band loop, but the loop itself is used to shoot a different projectile and is not intended to be released from the gun. Similarly, Pohr U.S. Pat. No. 3,704,981, issued Dec. 5, 1972, discloses a gunlike device having an elongated barrel portion and an elastic member with one end portion secured to the barrel such that the other end portion can be stretched and released to snap forward without separation of the elastic member from the barrel.

SUMMARY OF THE INVENTION

The principal object of the present invention is to provide a novel projectile toy of the type for shooting an elastic projectile which toy is of simple inexpensive construction and easy and amusing to use by the young and young at heart, but in a form that achieves consistent accurate projection of the projectile dependent almost exclusively on the skill of the user in maintaining a steady and consistent aim.

In the preferred embodiment of the present invention, the foregoing object is accomplished by providing an elongated stock resembling a carbine including respective butt and barrel end portions with a central trigger mechanism that can be manipulated to project and retract an upright pin. The barrel end of the stock has a long horizontal blind bore into which one end portion of an elongated elastic projectile in the form of a resilient tube is inserted. From the open end of the bore, the elastic projectile is bent abruptly rearward and stretched along the top of the barrel. The rear end portion of the projectile is fitted over the upper portion of the trigger pin. Retraction of such pin by manipulation of the trigger mechanism releases the projectile which flies forward with surprising accuracy, consistently in alignment with the longitudinal axis of the barrel portion of the stock.

DETAILED DESCRIPTION

Figures 1, 2, 3, 4, 5, 6:
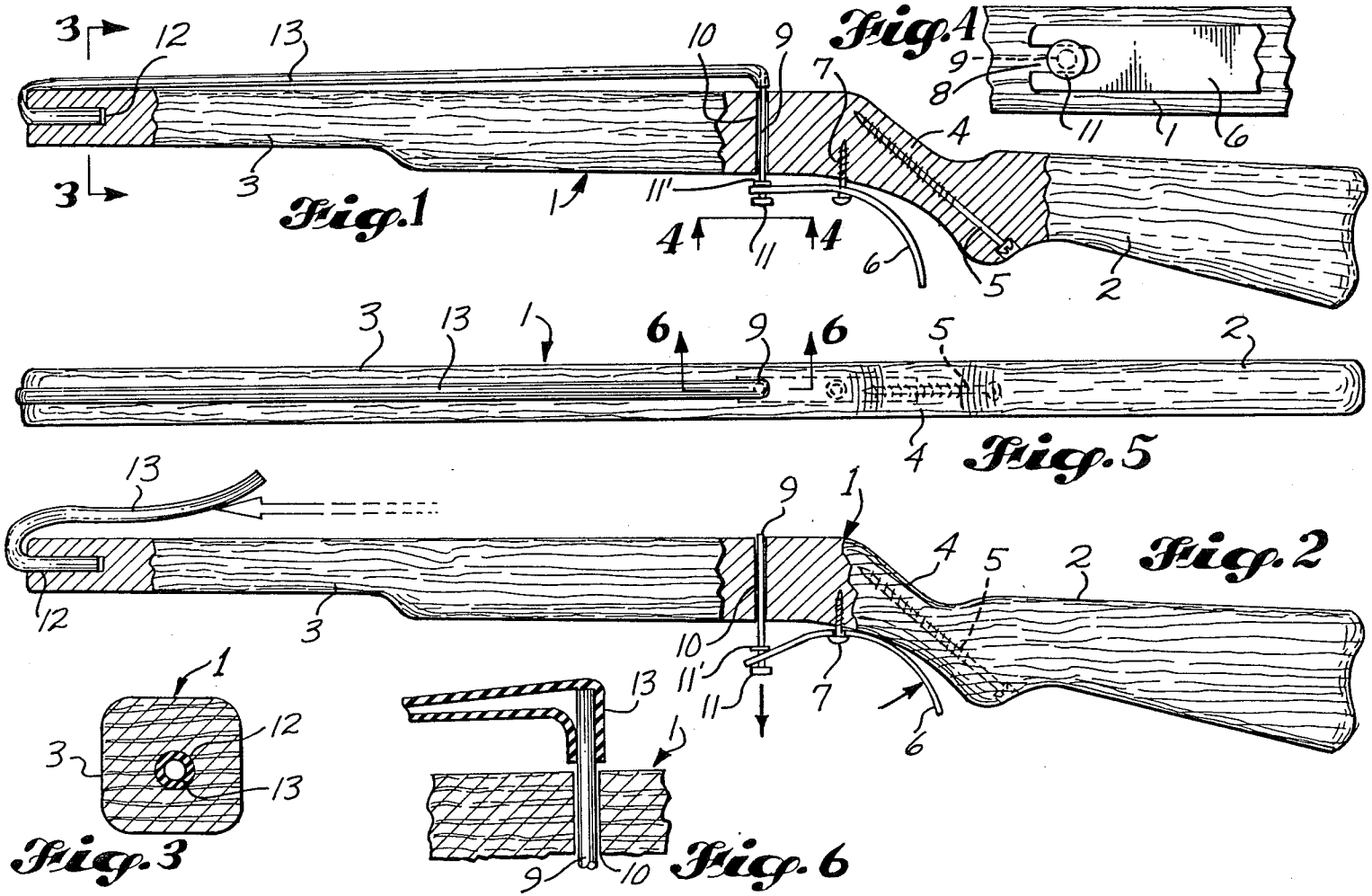
FIG. 1 is a side elevation of a projectile toy in accordance with the present invention showing the elongated elastic projectile component in its stretched firing condition, with parts broken away.
FIG. 2 is a somewhat diagrammatic corresponding side elevation of such toy shortly after release of the projectile, with parts broken away.
FIG. 3 is an enlarged vertical section along line 3—3 of FIG. 1.
FIG. 4 is an enlarged fragmentary bottom plan viewed from line 4—4 of FIG. 1.
FIG. 5 is a top plan of the toy in accordance with the present invention in the condition shown in FIG. 1.
FIG. 6 is an enlarged fragmentary transverse section along line 6—6 of FIG. 5.

With reference to the drawings, the projectile toy in accordance with the present invention includes a stock 1 including a horizontally elongated butt portion 2, a horizontally elongated barrel portion 3 opposite the butt portion and a narrow inclined central section 4 joining the butt and barrel portions. As in a standard carbine, the butt and barrel portions are offset vertically and the stock is narrowed in the area of its inclined central or joining section 4. In the preferred embodiment, the stock is formed of wood with the grain running lengthwise of the butt and barrel portions. To deter splitting or cracking of the stock in the narrowed central portion 4 between the offset butt and barrel portions, a long internal screw 5 extends through the joining section 4 in substantial alignment with the length of such section.

The toy in accordance with the present invention has actuating mechanism including a simple curved trigger 6 formed of flat bar. The trigger bar has a central hole for a pivot in the form of an upright screw 7 extending a substantial distance into the stock 1 to increase the internal reinforcement in the general area of the joining section 4. The rear end portion of the trigger bar 6 is curved downward from the pivot screw 7 generally along the underside of the inclined joining section 4 of the stock. The front end portion of the trigger bar extends forward from such screw.

As best seen in FIG. 4, the leading end portion of the trigger bar 6 is bifurcated to form a forward-opening slot 8 to receive the shank of an upright actuating or trigger pin 9. The trigger pin extends through an upright bore 10 in the barrel portion 3 of the stock adjacent to the joining section 4. Pin 9 has a bottom enlarged head 11 below the bifurcations of the trigger bar 6 and a retainer 11' above them. Manual fore-and-aft swinging of the rear end portion of the trigger bar effects substantially vertical translation of the trigger pin 9 between the projected position shown in FIG. 1 in which the upper end portion of the pin extends a substantial distance above the top of the stock 1 and the retracted position shown in FIG. 2 in which the pin is retracted into the bore 10.

The leading barrel end of the stock has a cylindrical horizontal blind bore 12. The diameter of bore 12 preferably is substantially the same as the outer diameter of a cylindrical elastic projectile 13 which, in the preferred embodiment, is tubular. Preferably, the length of bore 12 is at least several times its diameter, i.e., several times the outer diameter of the projectile 13 so that a considerable length of one end portion of the projectile can be inserted into the bore.

After insertion of one end portion of the tubular elastic projectile 13 into the horizontal barrel bore 12, the projecting portion of the projectile is bent abruptly upward and rearward. Friction of the return bent portion of the projectile against the tip of the barrel retains the leading end portion of the projectile 13 in the bore 12 as the trailing end portion is manually stretched rearward to the trigger pin 9. With the trigger pin in the projected position illustrated in FIGS. 1 and 6, the rear end portion of the tubular projectile is fitted downward over the pin. In relaxed condition, the internal diameter of the projectile is approximately the same as the outer diameter of the pin for a snug fit. When the grip on the projectile is gradually released, however, tension of the projectile deforms it approximately to the condition shown in FIG. 6.

Shooting of the projectile 13 is achieved by pulling or squeezing the downward curved portion of the trigger bar 6 rearward to retract the upright trigger pin 9 to the position shown in FIG. 2. The rear end portion of the projectile 13 engages against the top of the stock 1 as the trigger pin 9 slides downward in the bore 10. The projectile is released from the pin and, as illustrated in FIG. 2, flies forward while the leading end portion of the projectile remains fitted at least partially in the bore 12. Even from a distance of 15 or 20 feet or more, a skilled marksman can hit a small target. It is believed that the long length of the tubular projectile fitted in the horizontal bore 12 aligned with the barrel portion 3 of the stock contributes to the accuracy.

In the preferred embodiment, the projectile can be natural latex tubing such as the "806R" tubing available from Kent Latex Products, Inc. of Kent, Ohio. In the relaxed condition such preferred tubing has an inside diameter of $\frac{1}{4}$ inch and a 3/32 inch wall thickness resulting in an outside diameter of 7/16 inch. The bore 12 in the leading end portion of the stock preferably is approximately 7/16 inch in diameter and can be 2 to 2 $\frac{1}{2}$ inches deep. For a gun of a length of about 19 inches from the tip of the barrel to the upright trigger pin, the overall length of the projectile in relaxed condition can be about 12 inches. The diameter of the trigger pin preferably is about $\frac{1}{4}$ inch, i.e., approximately equal to the inside diameter of the projectile, and in the upward projected position, the upper end portion of the trigger pin should extend above the top of the barrel a distance at least $\frac{1}{2}$ inch, i.e., at least twice the inside diameter of the projectile so that the projectile does not inadvertently slip off the pin.

The simple mechanical construction of the projectile toy in accordance with the present invention allows for long trouble-free operation and the preferred natural latex tubing projectile can be used repeatedly without loosing its resiliency or breaking.

I claim:

1. A projectile toy comprising a stock having a horizontally elongated barrel portion and a horizontally elongated butt portion opposite said barrel portion, said barrel portion having a tip remote from said butt portion, said tip of said stock barrel portion having an outward-opening blind bore aligned with the length of said barrel portion, said bore being at least several times longer than its diameter, an elongated cylindrical tubular elastic projectile having an outside diameter approximately equal to the diameter of said bore for fitting of a considerable length of said projectile into said bore leaving a long section of projectile projecting from said bore for bending around said tip and stretching of said projectile rearward toward said stock butt portion, and trigger means mounted on said stock including means for securing the end portion of said projectile remote from its end portion received in said bore in substantially fixed position relative to said stock, said trigger means including an elongated trigger pin and means for reciprocating said pin transversely of the length of said stock barrel portion between a projected position for fitting of an end portion of said projectile over said pin and a retracted position for releasing such end portion from said pin so as to effect projection of said projectile from said stock.

2. The projectile toy defined in claim 1, in which the internal diameter of the tubular projectile in relaxed condition is approximately the same as the diameter of the trigger pin.

3. A projectile toy comprising a stock having a horizontally elongated barrel portion and a horizontally elongated butt portion opposite said barrel portion, said barrel portion having a tip remote from said butt portion, said tip of said stock barrel portion having an outwardopening blind bore aligned with the length of said barrel portion, an elongated tubular, elastic projectile having an outside diameter approximately equal to the diameter of said bore for fitting of one end portion of said projectile into said bore leaving a long section of said projectile projecting from said bore for bending around said tip and stretching of said projectile rearward toward said stock butt portion, and trigger means mounted on said stock including means for securing the end portion of said projectile remote from its end portion received in said bore in substantially fixed position relative to said stock, said trigger means being manipulable so as to release said other end portion of said projectile so as to effect projection of said projectile from said stock and including an elongated trigger pin and means for reciprocating said pin transversely of the length of said stock barrel portion between a projected position for fitting of an end portion of said projectile over said pin and a retracted position for releasing such end portion from said pin.

4. The projectile toy defined in claim 3, in which the internal diameter of the tubular projectile in relaxed condition is approximately the same as the diameter of the trigger pin.

* * * * *